US009526944B2

(12) United States Patent
Knies

(10) Patent No.: US 9,526,944 B2
(45) Date of Patent: Dec. 27, 2016

(54) EXERCISE APPARATUS FOR THE JAW AND FACIAL MUSCLES

(71) Applicant: Adriana Knies, Plantation, FL (US)

(72) Inventor: Adriana Knies, Plantation, FL (US)

( * ) Notice: Subject to any disclaimer, the term of this patent is extended or adjusted under 35 U.S.C. 154(b) by 0 days.

(21) Appl. No.: 14/299,376

(22) Filed: Jul. 18, 2014

(65) Prior Publication Data

US 2016/0016039 A1 Jan. 21, 2016

(51) Int. Cl.

| | |
|---|---|
| ***A63B 23/03*** | (2006.01) |
| ***A63B 21/00*** | (2006.01) |
| ***A63B 21/068*** | (2006.01) |
| *A63B 23/00* | (2006.01) |

(52) U.S. Cl.

CPC ..... *A63B 23/03* (2013.01); *A63B 21/0004* (2013.01); *A63B 21/068* (2013.01); *A63B 21/4003* (2015.10); *A63B 2023/006* (2013.01)

(58) Field of Classification Search

CPC ..... A63B 21/00141; A63B 21/065; A63B 21/1403; A63B 21/1407; A63B 21/1449; A63B 23/025; A63B 23/03; A63B 23/032; A63B 71/10; A63B 21/00058; A63B 21/00061; A63B 21/00065; A63B 21/40; A63B 21/4001; A63B 21/4025; A63B 21/4003

USPC ..... 482/10, 11, 93, 105; 601/38, 39

See application file for complete search history.

(56) References Cited

U.S. PATENT DOCUMENTS

| | | | | | |
|---|---|---|---|---|---|
| 3,820,780 | A * | 6/1974 | Tarbox | A63B 21/0603 | 128/97.1 |
| D235,789 | S * | 7/1975 | Eberhardt | 482/105 | |
| 4,189,141 | A * | 2/1980 | Rooney | A63B 23/03 | 482/105 |
| 4,195,833 | A * | 4/1980 | Svendsen | A63B 21/065 | 482/105 |
| 4,650,182 | A * | 3/1987 | Ross | A63B 23/03 | 433/5 |
| 5,162,027 | A * | 11/1992 | Robinson | A63B 23/025 | 482/10 |
| 5,484,359 | A * | 1/1996 | Wabafiyebazu | A63B 21/0004 | 482/10 |
| 6,248,043 | B1 * | 6/2001 | Morton | A63B 21/0004 | 482/11 |
| 6,277,053 | B1 * | 8/2001 | Desembrana | A63B 23/03 | 482/11 |
| 7,000,615 | B2 * | 2/2006 | Taylor-Kennedy | A61F 5/56 | 128/857 |
| D617,907 | S * | 6/2010 | Waller | D24/191 | |
| 2003/0073549 | A1 * | 4/2003 | Hatch | A63B 21/0601 | 482/92 |
| 2008/0010724 | A1 * | 1/2008 | Curphey | A63B 21/065 | 2/322 |
| 2012/0255097 | A1 * | 10/2012 | Feuchs | A41D 13/065 | 2/22 |

(Continued)

*Primary Examiner* — Loan H Thanh
*Assistant Examiner* — Gregory Winter

(57) ABSTRACT

A portable exercise apparatus to condition facial muscles of a user to improve health, quality and physicality of the mandibular area, double chin, and jaw line using repetitive and continuous movements. The apparatus tones the facial muscles and movements of the lower part of the face including the mandibular area, double chin, and jaw line with the use of removable weights. The apparatus contains two individual parts made of flexible fabric with unique shape and curves that interlock to form one exercise apparatus.

1 Claim, 12 Drawing Sheets

(56) References Cited

U.S. PATENT DOCUMENTS

2013/0331241 A1* 12/2013 Spina ..... A63B 21/00185
482/124

* cited by examiner

EXERCISE APPARATUS FOR THE JAW AND FACIAL MUSCLES

FIELD OF THE INVENTION

The present invention relates to a portable exercise apparatus to condition facial muscles of a user to improve health, quality and physicality of the mandibular area, double chin, and jaw line.

DETAILED DESCRIPTION OF THE DRAWINGS

Figure 1:
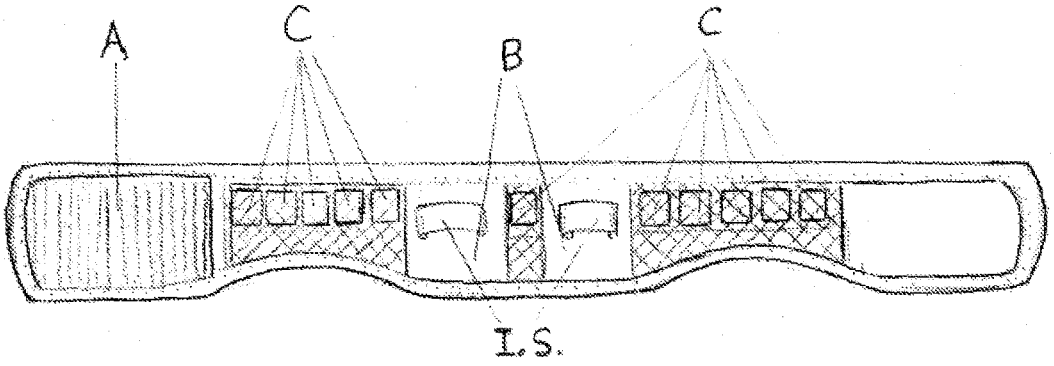
FIG. 1 is part one of the exercise apparatus made of flexible fabric.

FIG. 1 shows a first part or first member of the exercise apparatus including a band (B) of flexible fabric that contains a total of eleven pockets that each hold one square weight with round shaped edges that can be removed and adjusted according to the user's need to increase or decrease resistance. FIG. 1 also shows the interlocking system (I.S.), that is used for interlocking part one and part two, forming one exercise apparatus, the interlocking system including two loops extending from the first part. Part one has curved edges that go around the ears to provide comfort to the user. FIG. 1 also shows the latching mechanism (A) for releasably attaching the ends of part one.

Figure 2:
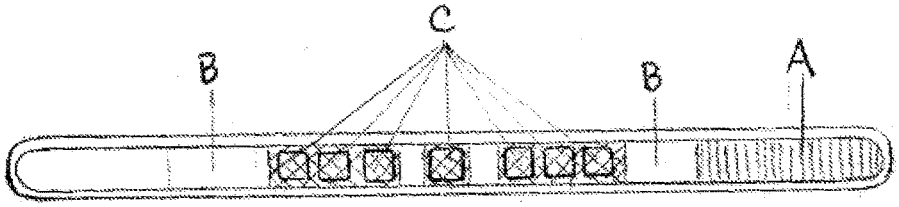
FIG. 2 is part two of the exercise apparatus made of flexible fabric.

FIG. 2 shows part two or a second member of the exercise apparatus including a band (B) made of flexible fabric that contains a total of six pockets that each hold one square weight with round shaped edges that can be removed and adjusted according to the user's need to increase or decrease resistance. FIG. 2 also shows the latching mechanism (A) for releasably attaching the ends of part two.

Figure 3:
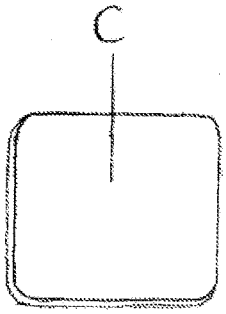
FIG. 3 is one square weight with round shaped edges.

FIG. 3 shows one square weight (C) with round shaped edges.

Figure 4:
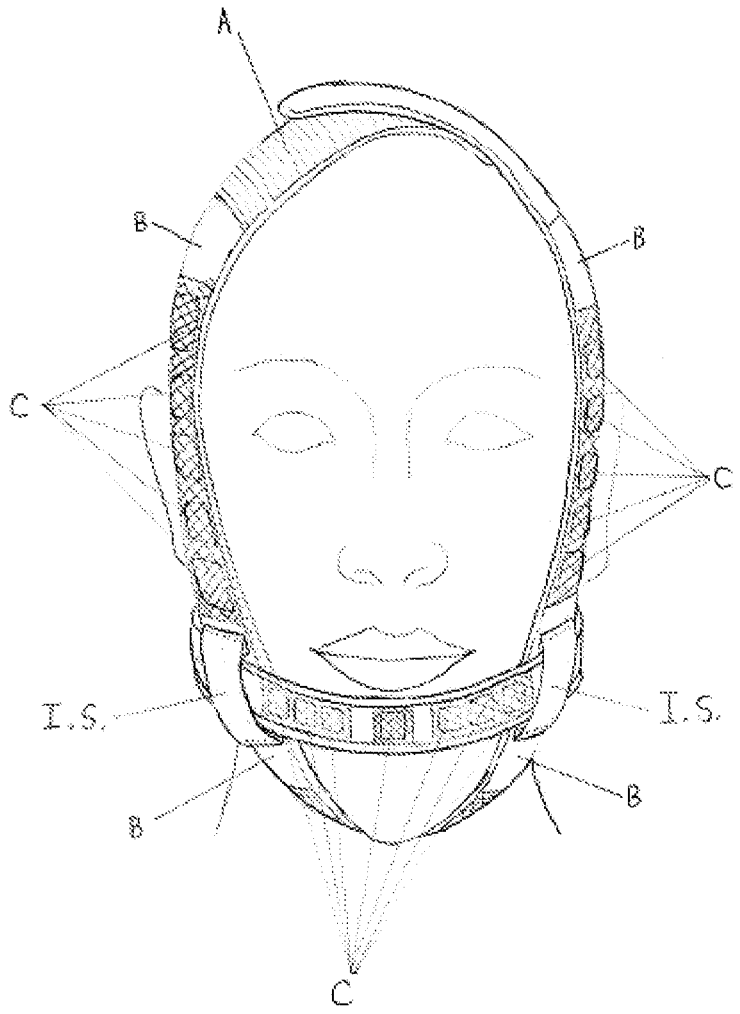
FIG. 4 is part one and two of the exercise apparatus made of flexible fabric, interlocked in forward view position.

FIG. 4 shows part one and two of the exercise apparatus made of flexible fabric, interlocked in forward view position.

Figure 5:
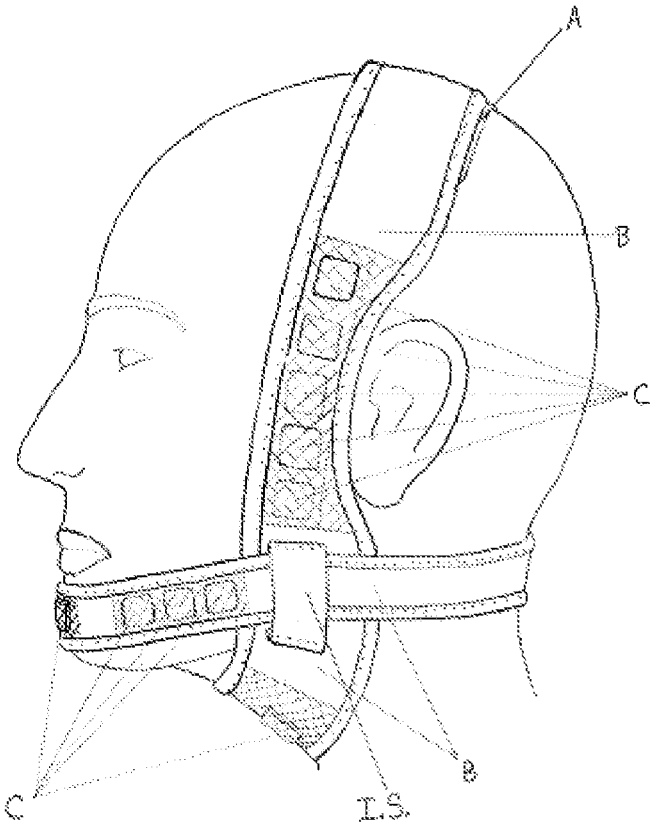
FIG. 5 is part one and two of the exercise apparatus made of flexible fabric interlocked sideways view position.

FIG. 5 shows part one and two of the exercise apparatus made of flexible fabric interlocked in sideways view position demonstrating its curved edges around the ears.

Figure 6:
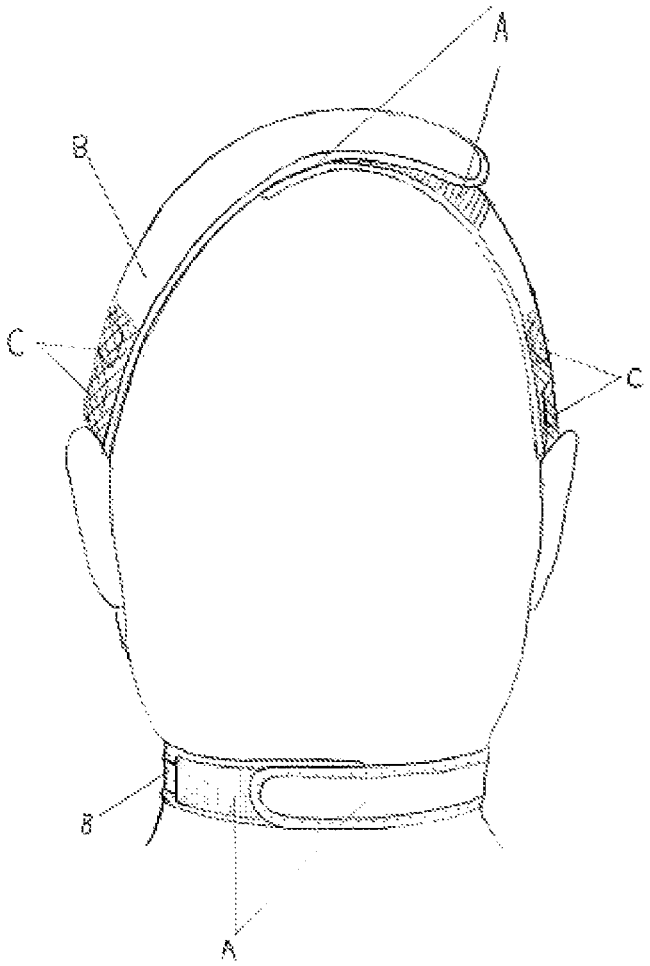
FIG. 6 is part one and two of the exercise apparatus made of flexible fabric interlocked in back of the head view position.

FIG. 6 shows part one and two of the exercise apparatus made of flexible fabric interlocked in back of the head view position.

Figure 7:
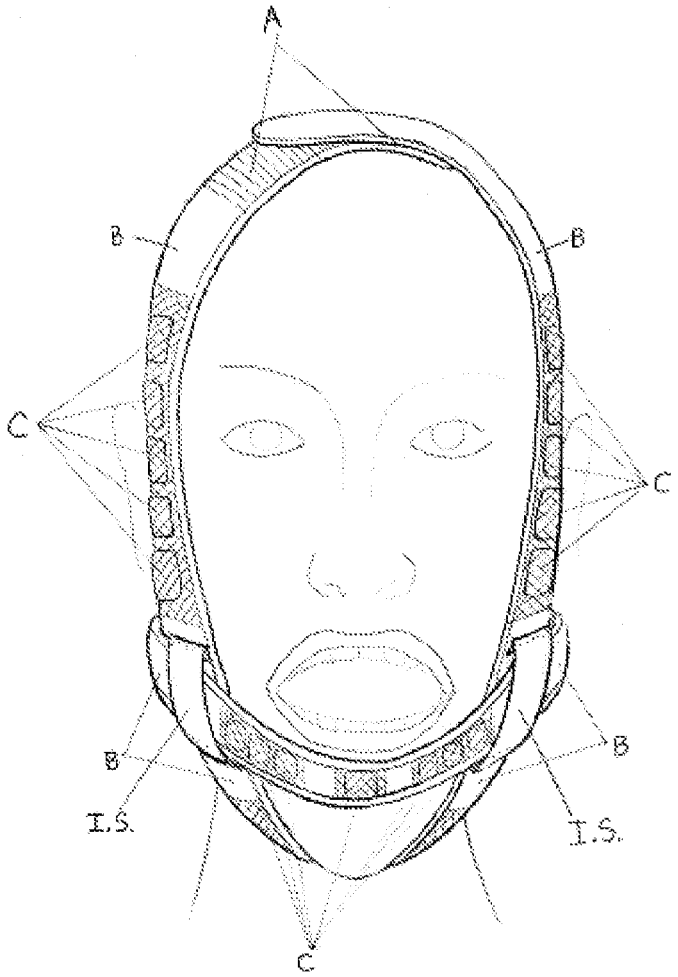
FIG. 7 is part one and two of the exercise apparatus made of flexible fabric interlocked in forward view, with open mouth position.

FIG. 7 shows part one and two of the exercise apparatus made of flexible fabric interlocked in forward view, with open mouth position. This exercise illustrated with opening and closing of the mouth and moving the mouth and jawline downwards and repeating this movement as the user see fits in slow daily increments increases the health of the mandibular area and decreases the double chin.

Figure 8:
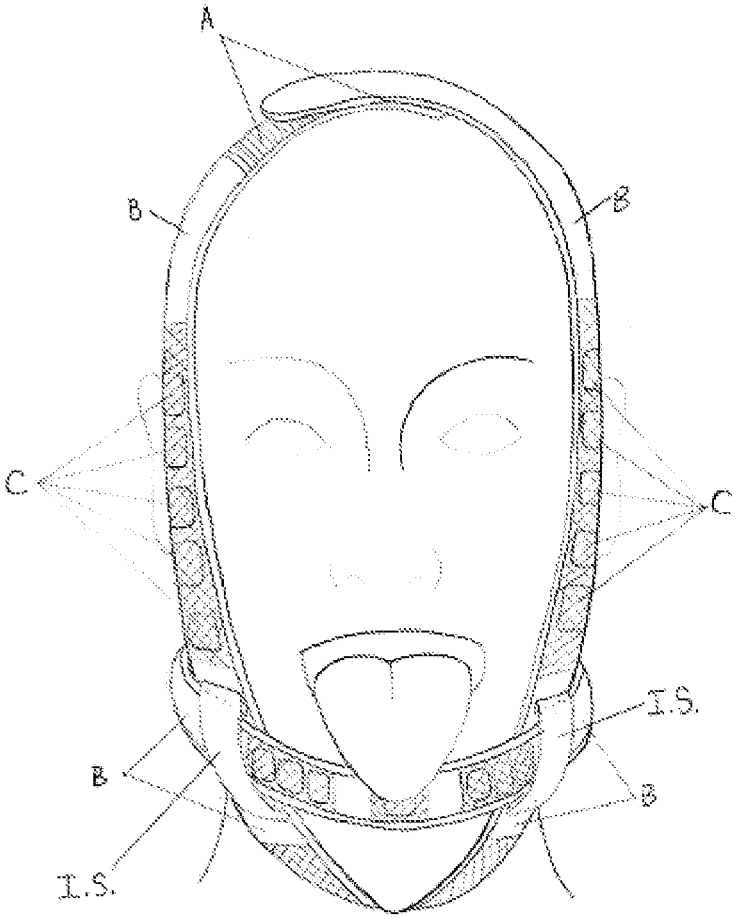
FIG. 8 is part one and two of the exercise apparatus made of flexible fabric interlocked in forward view, with open mouth and tongue out position.

FIG. 8 shows part one and two of the exercise apparatus made of flexible fabric interlocked in forward view, with open mouth and tongue out position. This rehabilitating exercise position increases resistance to the jawline going downwards, with open and closing of the mouth, and the extending of the tongue outwards. Repeating this movement as the user see fits, in slow daily increments, increases the health of the mandibular area and jawline and decreases the double chin.

Figure 9:
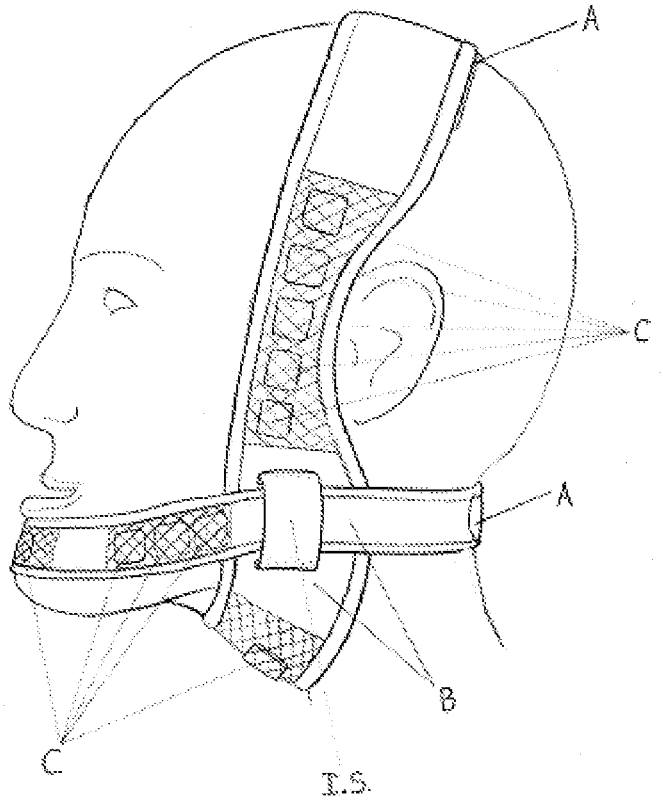
FIG. 9 is part one and two of the exercise apparatus made of flexible fabric interlocked in sideways view, with lower jaw moving forward position.

FIG. 9 shows part one and two of the exercise apparatus made of flexible fabric interlocked in sideways view, with lower jaw moving forward position. This rehabilitating exercise illustrates the jawline moving forward and backward. Repeating this movement as the user see fits, in slow daily increments, also increases the health of the mandibular area and jawline and decreases the double chin.

Figure 10:
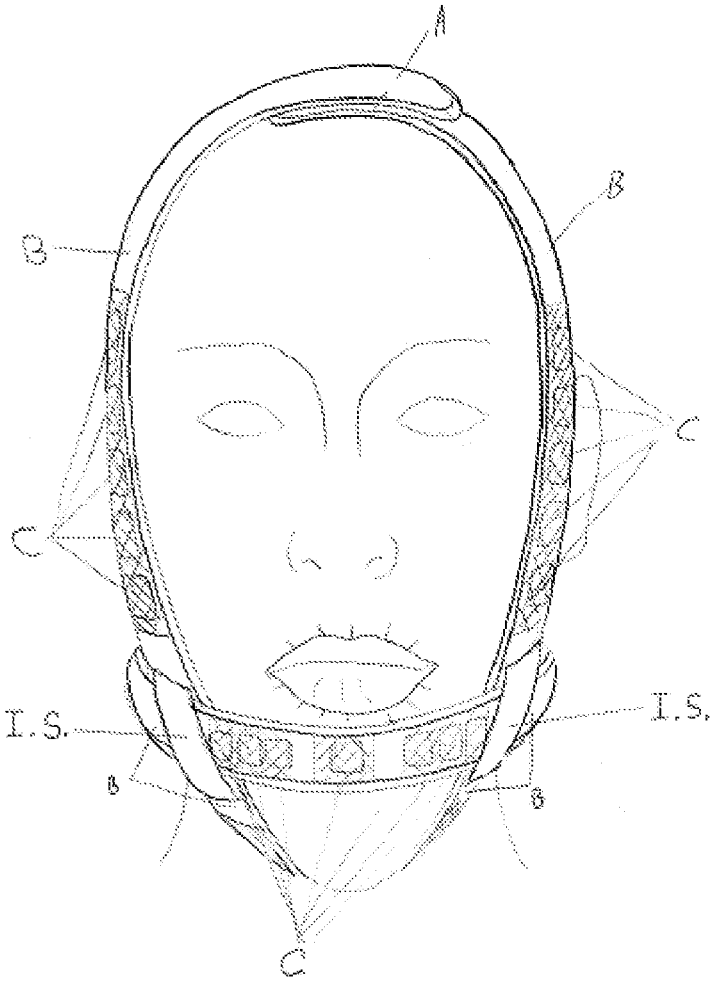
FIG. 10 is part one and two of the exercise apparatus made of flexible fabric interlocked in forward view, with lips forward position, blowing kisses.

FIG. 10 shows part one and two of the exercise apparatus made of flexible fabric interlocked in forward view, with lips forward position, blowing kisses. This rehabilitating exercise illustrates the user extending the upper and lower lip in the forward position. Repeating this movement as the user see fits in slow daily increments also increases the health of the mandibular area and jawline and decreases the double chin.

Figure 11:
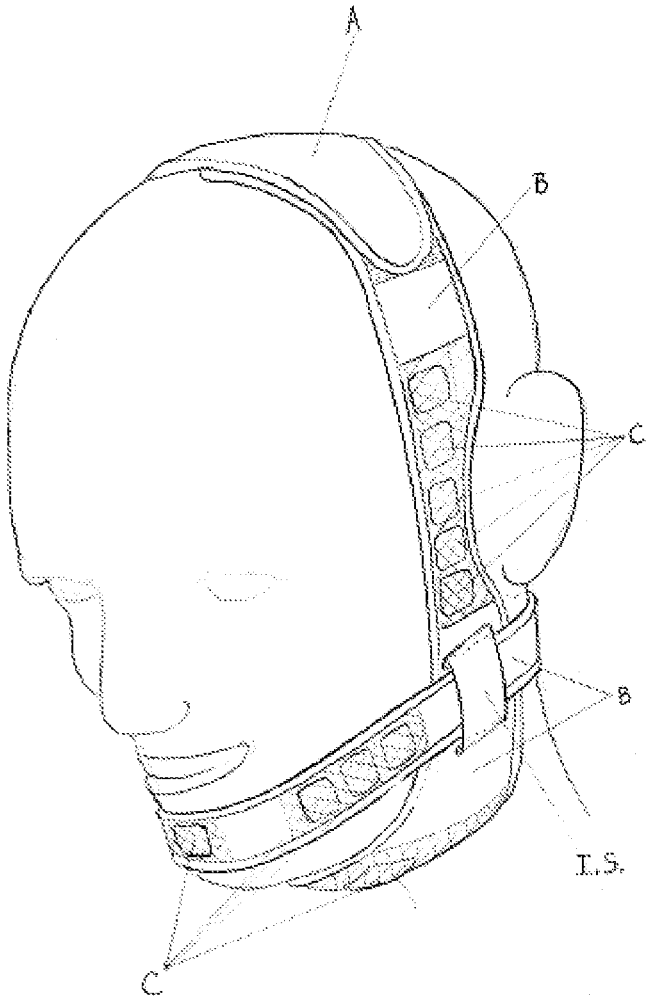
FIG. 11 is part one and two of the exercise apparatus made of flexible fabric interlocked in forward view, with head and lower jaw downwards position.

FIG. 11 shows part one and two of the exercise apparatus made of flexible fabric interlocked in forward view, with head and lower jaw downwards position. This rehabilitating exercise illustrates the user lowering the chin with a closed mouth downward pressing the jawline towards the collarbone, and moving upwards and downwards. Repeating this movement as the user see fits in slow daily increments also increases the health of the mandibular area and jawline and decreases the double chin.

Figure 12:
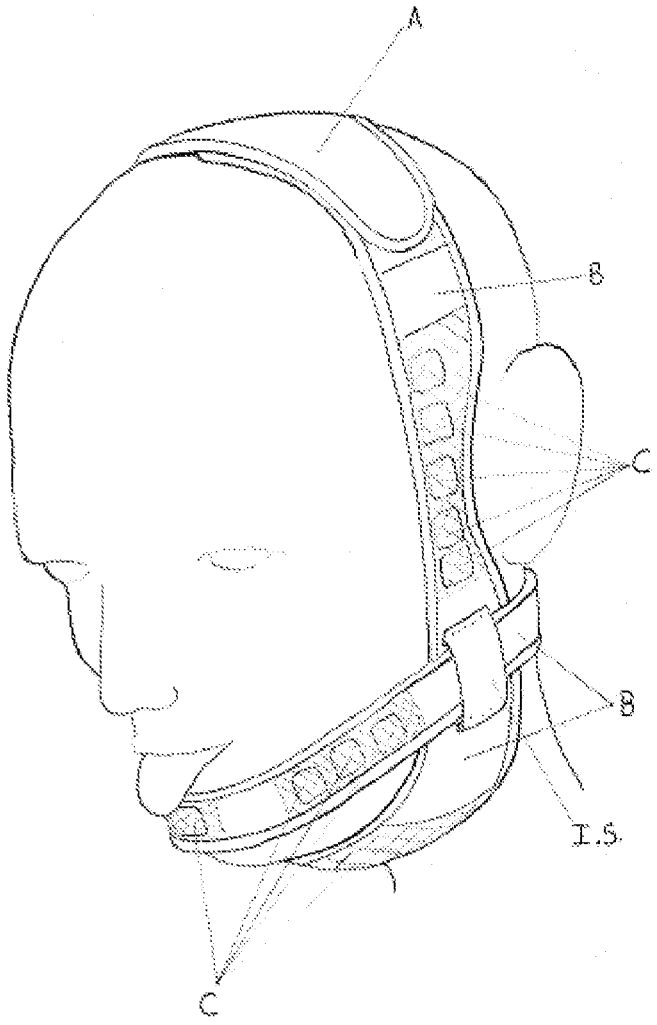
FIG. 12 is part one and two of the exercise apparatus made of flexible fabric interlocked in forward view, with head and lower jaw downwards with tongue out position.

FIG. 12 shows part one and two of the exercise apparatus made of flexible fabric interlocked in forward view, with head and lower jaw downwards with tongue out position. This rehabilitating exercise illustrates the user lowering the chin with an open mouth and tongue out, downward pressing the jawline towards the collarbone, and moving it downwards and upwards. Repeating this movement as the user see fits in slow daily increments also increases the health of the mandibular area and jawline and decreases the double chin.

Figure 13:
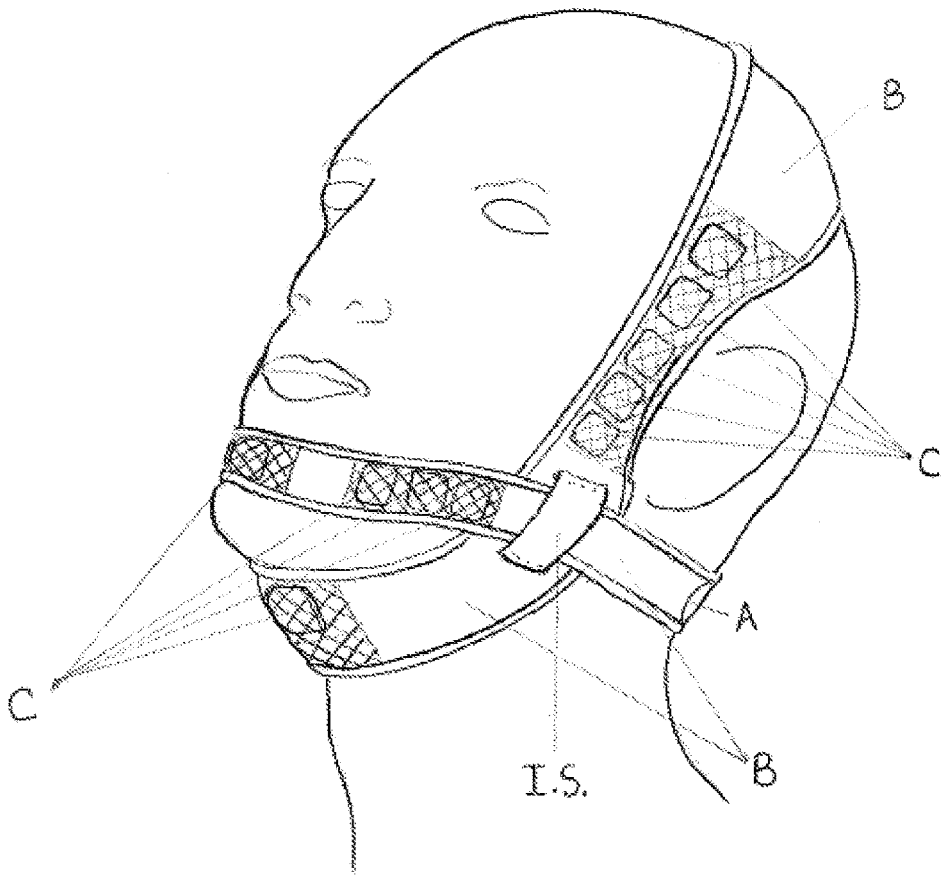
FIG. 13 is part one and two of the exercise apparatus made of flexible fabric interlocked in forward view, with head and lower jaw position upwards.

FIG. 13 shows part one and two of the exercise apparatus made of flexible fabric interlocked in forward view with head and lower jaw position upwards. This rehabilitating exercise illustrates the user looking up and holding the jawline upwards and moving the head upwards and downwards. Repeating this movement as the user see fits in slow daily increments also increases the health of the mandibular area and jawline and decreases the double chin.

Figure 14:
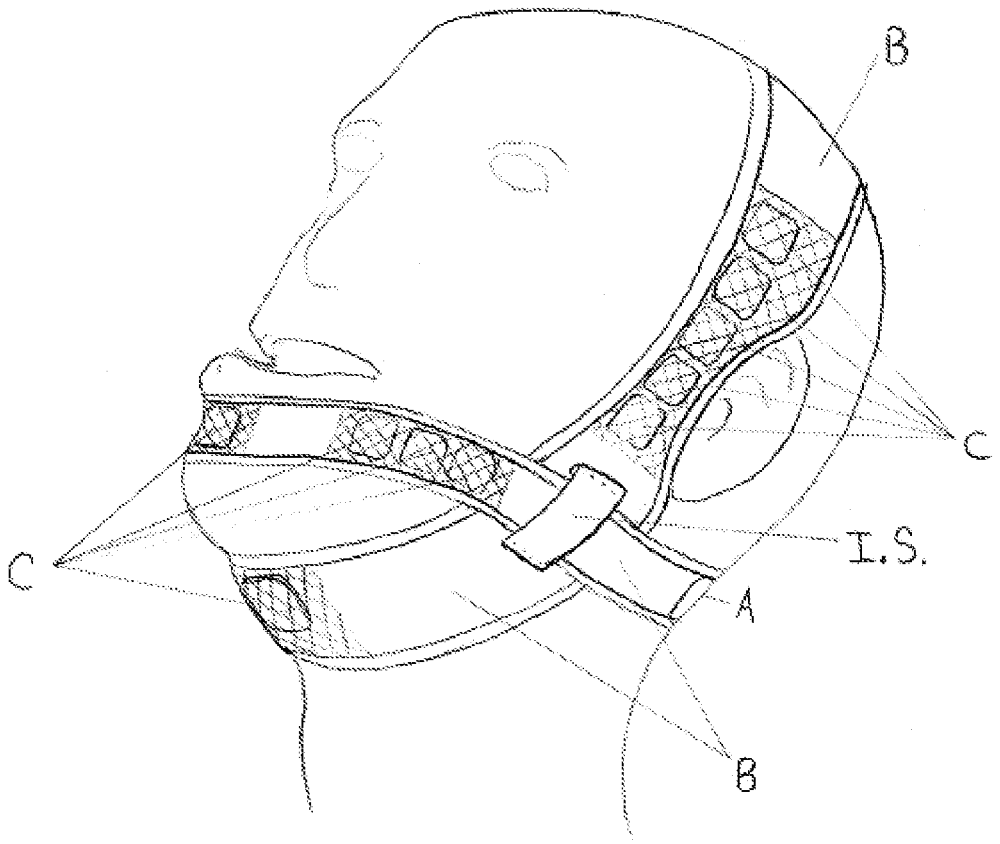
FIG. 14 is part one, and two of the exercise apparatus made of flexible fabric interlocked in sideways view, with lower jaw moving position upwards.

FIG. 14 shows part one and two of the exercise apparatus made of flexible fabric interlocked in sideways view, with lower jaw moving position upwards. This rehabilitating exercise illustrates the user looking upwards, the jawline in an upward position, and moving the jawline forward and backward. Repeating this movement as the user see fit in slow daily increments also increases the health of the mandibular area and jawline and decreases the double chin.

The invention claimed is:

1. An apparatus for improving and toning facial muscles of a user, the apparatus comprising:

a first member comprising:

a flexible band configured to be worn around a head of the user such that the first member extends from below the chin of the user to around the top of the head of the user;

a first end and a second end each comprising a latching mechanism for releasably attaching the first end and the second end at the top of the head of the user;

an interlocking system comprising a first loop and a second loop extending from the first member and located between the first end and the second end;

a square-shaped pocket positioned between the first loop and the second loop of the interlocking system, five square-shaped pockets positioned between the first end and the first loop of the interlocking system, and five square-shaped pockets positioned between the second end and the second loop of the interlocking system, each of the square-shaped pockets configured for releasably receiving a square-shaped weight for adjusting a weight of the first member; and a first curved edge positioned between the first end and the first loop of the interlocking system and a second curved edge positioned between the second end and the second loop of the interlocking system, the curved edges configured to fit around the ears of the user; and a second member comprising:

a flexible band configured to be worn around the head of the user such that the second member extends from in front of the chin of the user to around the back of the head of the user;

a first end and a second end each comprising a latching mechanism for releasably attaching the first end of the second member and the second end of the second member at the back of the head of the user; and a square-shaped pocket positioned at a midpoint of a length of the second member, three square-shaped pockets positioned between the first end of the second member and the midpoint, and three square-shaped pockets positioned between the second end of the second member and the midpoint, each of the square-shaped pockets configured for releasably receiving a square-shaped weight for adjusting a weight of the second member;

wherein the interlocking system is configured to releasably connect the first member and the second member such that the second member extends through the first loop at a first side of the head of the user and the second member extends through the second loop at a second side of the head of the user.

* * * * *